US006881886B2

(12) United States Patent
May

(10) Patent No.: US 6,881,886 B2
(45) Date of Patent: Apr. 19, 2005

(54) CARRIER ASSEMBLY FOR PERCUSSION INSTRUMENTS

(76) Inventor: Randall L May, 2 Trafalgar, Newport Beach, CA (US) 92660

( * ) Notice: Subject to any disclaimer, the term of this patent is extended or adjusted under 35 U.S.C. 154(b) by 21 days.

(21) Appl. No.: 10/831,638

(22) Filed: Apr. 23, 2004

(65) Prior Publication Data

US 2004/0194608 A1 Oct. 7, 2004

Related U.S. Application Data

(63) Continuation-in-part of application No. 10/374,676, filed on Feb. 26, 2003, and a continuation-in-part of application No. 10/170,005, filed on Jun. 10, 2002, now Pat. No. 6,770,805, and a continuation-in-part of application No. 08/976,999, filed on Nov. 24, 1997, now Pat. No. 6,028,257, and a continuation-in-part of application No. 08/588,244, filed on Jan. 18, 1996, now Pat. No. 5,691,492.

(51) Int. Cl.[7] ..... G10D 13/02
(52) U.S. Cl. ..... 84/421; 84/317; 248/443
(58) Field of Search ..... 84/421, 327; 224/225, 224/226; 248/443

(56) References Cited

U.S. PATENT DOCUMENTS

| | | | | |
|---|---|---|---|---|
| 4,256,007 A | | 3/1981 | Streit | |
| 4,387,839 A | | 6/1983 | Dranchak | |
| 4,402,441 A | | 9/1983 | Jones et al. | |
| 4,453,442 A | * | 6/1984 | LaFlame | 84/421 |
| 4,453,446 A | | 6/1984 | Hoshino | |
| 4,605,144 A | | 8/1986 | LaFlame | |
| 4,634,032 A | | 1/1987 | LaFlame | |
| 4,796,508 A | | 1/1989 | Hoshino | |
| 4,799,610 A | * | 1/1989 | Hsieh | 224/266 |
| 5,400,683 A | | 3/1995 | LaFlame | |
| 5,520,292 A | | 5/1996 | Lombardi | |
| 5,573,158 A | * | 11/1996 | Penn | 224/265 |
| 5,973,247 A | | 10/1999 | Matthews | |
| 6,028,257 A | | 2/2000 | May | |
| 6,172,290 B1 | | 1/2001 | May | |
| 6,323,407 B1 | | 11/2001 | May | |
| 6,329,583 B1 | | 12/2001 | May | |

OTHER PUBLICATIONS

U.S. Appl. No. 10/374,676, filed Nov. 2003, May.
U.S. Appl. No. 10/170,005, filed Jan. 2003, May.
U.S. Appl. No. 09/756,479, filed Dec. 2001, May.

* cited by examiner

*Primary Examiner*—Kimberly Lockett
(74) *Attorney, Agent, or Firm*—Buhler & Associates

(57) ABSTRACT

Drum hardware and drum secured thereon are preferably supported on a vest type carrier or a T-bar carrier having a plurality of separate parts removable from each other and formed of a rigid plastic, light metal such as magnesium, aluminum or titanium. The removable hardware includes a removable back support member. The removable back support member consists of hardware or configuration that can be removed or securely attach to the carrier with or without tools. The back member may be adjustable in width using slotted holes, telescoping components or sliding members. The adjustment to the back support member can be performed by adjusting the shoulder straps. The back member may be secured to changeable and or adjustable shoulder straps.

20 Claims, 5 Drawing Sheets

CARRIER ASSEMBLY FOR PERCUSSION INSTRUMENTS

CROSS REFERENCE TO RELATED APPLICATION

This application is a continuation-in-part of applicant's application Ser. No. 08/588,244, filed Jan. 18, 1996, now U.S. Pat. No. 5,691,492, issued Nov. 25, 1997 and Ser. No. 08/976,999 filed Nov. 24, 1997, now U.S. Pat. No. 6,028,257 issued Feb. 22, 2000, and application Ser. No. 10/170,005, filed Jun. 10, 2002, now U.S. Pat. No. 6,770,805 and application Ser. No. 10/374,676 filed Feb. 26, 2003.

FIELD OF THE INVENTION

This invention relates to new and useful improvements in apparatus for carrying percussion instruments, particularly drums of various kinds, cymbals, xylophones, and the like. More particularly, the present invention relates to a carrier hardware providing a novel support for percussion instruments and to carrier assemblies supporting percussion instruments on a person while standing, walking or marching. The carrier assembly has a construction and relationship of parts to transfer the weight of the percussion instrument (s) to the body of a person. The person carrying the instruments maintains a stable attitude while walking or marching about and avoids pressure or other forms of detrimental forces on the shoulders and lower back and is further characterized by having removable and/or adjustable back support member or members. The adjustment to the back support member position may also be accomplished using a fixed back support member with adjustable shoulder straps. The back member may be secured to the shoulder straps and the shoulder straps may be removable and or adjustable to accommodate different sized users.

BACKGROUND OF THE INVENTION

The prior art discloses many examples of apparatus for supporting percussion instruments but none providing the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back pressure plate, and wrap about shoulders and support straps connect to the abdominal plate, which has suitable fixtures for attachment of various percussion instruments. This invention does not disclose a removable back support member.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person. The patent includes a rigid band with a generally bent contour to extend along a portion of the waistline area of the person to the back of the person. The patent includes a back-plate riser arm supported by the ban to extend in a generally upward direction such that a portion of the arm will extend along the back thoracic region of the person, and means carried by the arm for imparting to the thoracic back region of the person. The arm causes a reactive force to the overhung weight of the instrument about the aforesaid means forming a fulcrum area of contact with the person.

May U.S. Pat. No. 5,691,492 discloses hardware for supporting drums that is of a hinged construction and has one part of the hinge connectable to an external support, e.g., J-rods on a fixed support or a marching drum carrier. Another part of the hinge is connectable to the shell of a drum or to the tension rods on a drum or to other hardware on the drum.

May U.S. Pat. No. 6,028,257 shows drum hardware and drums secured thereon preferably supported on a vest type carrier or a T-bar carrier or a fixed post or pedestal.

May U.S. Pat. No. 6,172,290 shows a hinged support for an array of drums.

May U.S. Pat. No. 6,323,407 discloses hardware and drums secured thereon preferably supported on a vest type carrier made of tubular construction.

May U.S. Pat. No. 6,329,583 discloses hardware and drums secured thereon preferably supported on a vest type carrier or a T-bar carrier with adjustable vest components.

May U.S. Pat. No. 6,403,869 discloses hardware and drums secured thereon preferably supported on a vest type carrier or a T-bar carrier with adjustable vest components.

The prior art discloses many examples of apparatus for supporting percussion instruments but none providing the combination of features disclosed and claimed herein.

BRIEF SUMMARY OF THE INVENTION

One of the objects of this invention is to provide a new and improved removable back support for a carrier assembly for musical instruments. The removable back support is attached to the carrier assembly using a variety of fasteners or interference or sliding components. Another object of the invention is to provide a removable back support that is padded to improve comfort to the user.

Another object of the invention is to provide the removable back support member that allows for width adjustment.

Another object of the invention is to provide changeable padding on the back support to allow for a variety of cushioning heights.

One object of the invention is to provide a new and improved carrier for percussion instruments, e.g., a snare drum, having hardware with a removable back bar, back plate, back member, back members, back support member or back pressure plate.

Another object of the invention is to provide a new and improved carrier for percussion instruments comprising a back support member with adjustable width Another object of the invention is to provide adjustment to the back support member where the back support member is attached to adjustable shoulder straps wherein adjustment to the shoulder straps, moves the back support member.

Another object of the invention is to provide a adjustable frictional pivoting mechanism to link the shoulder straps with the back member.

Another object of the invention is to provide a new and improved carrier for percussion instruments comprising a novel supporting vest of composite material (Fiberglas), rigid removable shoulder straps of light metal, and back member of light metal such as aluminum, magnesium, etc.

Another object of the invention is to provide a back member that is secured to shoulder straps that are removable and or adjustable to accommodate different sized users. The securing method may be rigidly secured or secured with fasteners that allow the back member to pivot on the shoulder straps. The secured back member may be adjustable for width.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
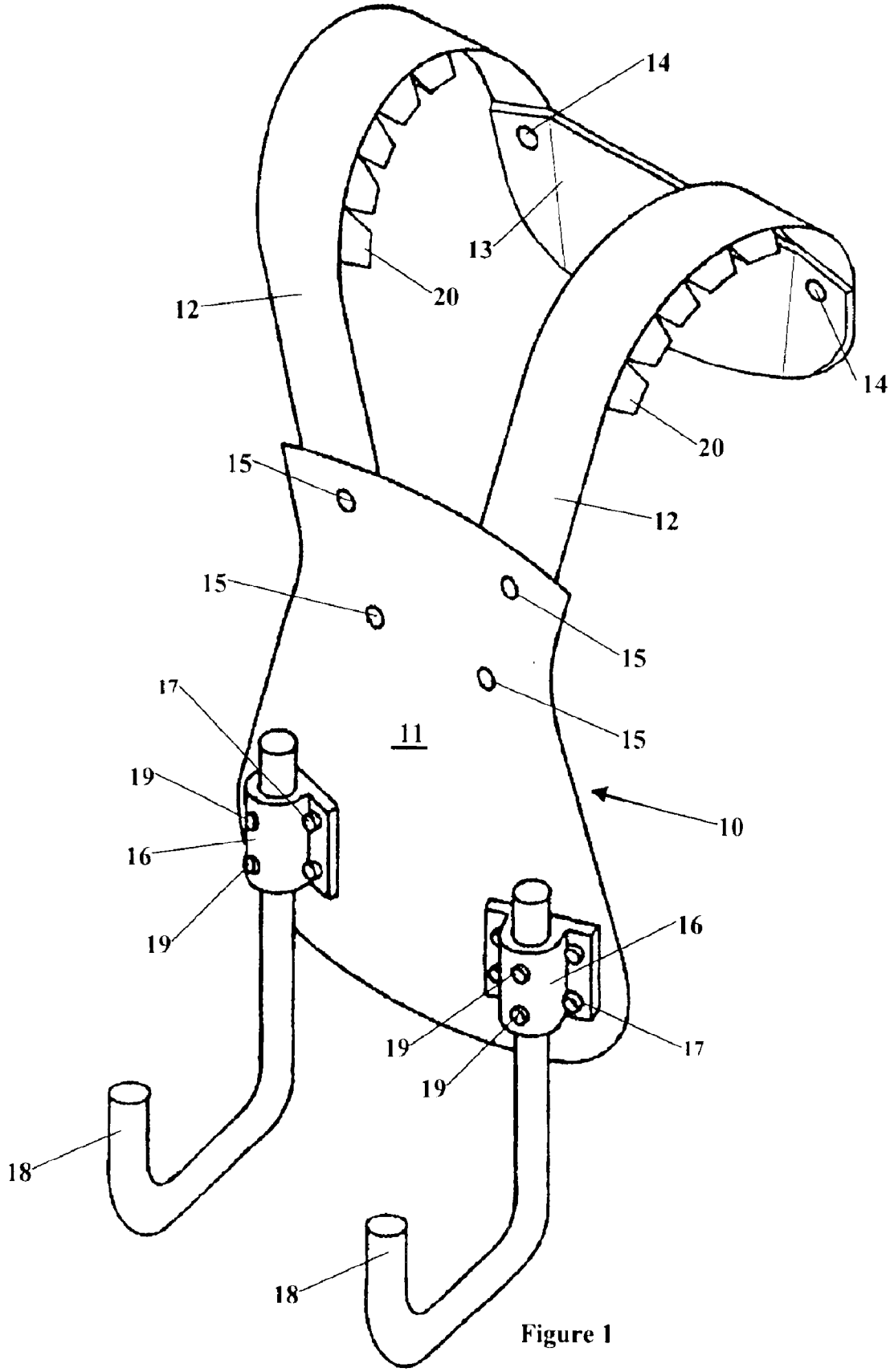
FIG. 1 is an isometric view of a novel supporting vest for marching drum assemblies with removable a back member.

Marching Vest Support with Removable Back Member for Drums and Other Percussion Instruments Referring to FIG. 1, there is shown a vest or harness-type 10 carrier for percussion instruments, which comprises a vest portion 11, shoulder straps 12, and back member 13. Back member 13 is removably secured to shoulder straps 12 by screws or bolts 14. Back member 13 may be fixed as by welding or the like. In this figure, the back support member is shown as a contoured plate that wraps around the back of the user to provide a wide support area. The back member may have multiple two or three-dimensional contours to fit the back region of the user. Vest portion 11 is removably secured to shoulder straps 12 by screws or bolts 15 and has a pair of J-rod receptacles 16 secured by screws or bolts 17. J-rods 18 are supported in receptacles 16 and secured in position by T-bolts or set screws 19. Shoulder straps 12 have cushions or pads 20 to cushion the load of the instruments carried by carrier 10.

The materials of construction used in this carrier 10 are very important for achieving the desired result. The vest portion 11 is preferably a strong, lightweight metal or composite material such as Fiberglas.RTM. Back member 13 and shoulder straps, 12 are rigid and made of a light metal such as aluminum, magnesium or titanium. The straps may also be molded or fabricated from a rigid non-metal material such as plastic. The back member can be removably secured to the shoulder straps. Some prior art vests of this type have been of a one-piece Fiberglas.RTM construction. There were incidents of failure of the shoulder straps from repeated flexing. The metal shoulder straps do not fail in flexure and have the advantage that they may be removed and different sizes are readily installed. The vest portion 11 can be of a single size and separate shoulder straps 12 of differing radii for small, medium, large or extra large size.

The cushions 20 are of a type used to pad the interior of football and other sports helmets. Cushions have a backing strip of polyvinyl plastic film. A thin sheet of polyvinyl film encloses blocks of closed pore plastic (e.g., polystyrene or polyurethane) foam and is sealed to the backing strip to enclose separate blocks. The blocks are separately compressible and provide more comfort to the wearer of the carrier when fully loaded. Shoulder straps 12 may be adjustable as in other embodiments below.

Operation

The operation of this carrier should be apparent but will be described briefly for clarity. The carrier 10 is worn by the musician with the shoulder straps 12 positioned over the shoulders and the vest 11 supported against his abdomen. Pads 20 on shoulder straps 12 cushion the load of the instruments carried by carrier 10. Pads 20 may also be used in padding the back support member 13 or vest belly plate portion 11.

Vest 11 may have suitable padding over its inner surface, as needed, to avoid discomfort from the bolts or screws 15 used to assemble the straps to the vest or bolts or screws 17 used to assemble receptacles 16 on the vest. Back member 13 may be removed or omitted for the convenience of drummers who prefer an open back. J-rods 18 are inserted in position and secured in place by tightening set-screws 19. The short outer ends of the J-rods are inserted into the J-rod receptacles on the percussion instrument being carried, e.g., drums (single or array), cymbals, xylophone, marimba, or the like.

Figure 2:
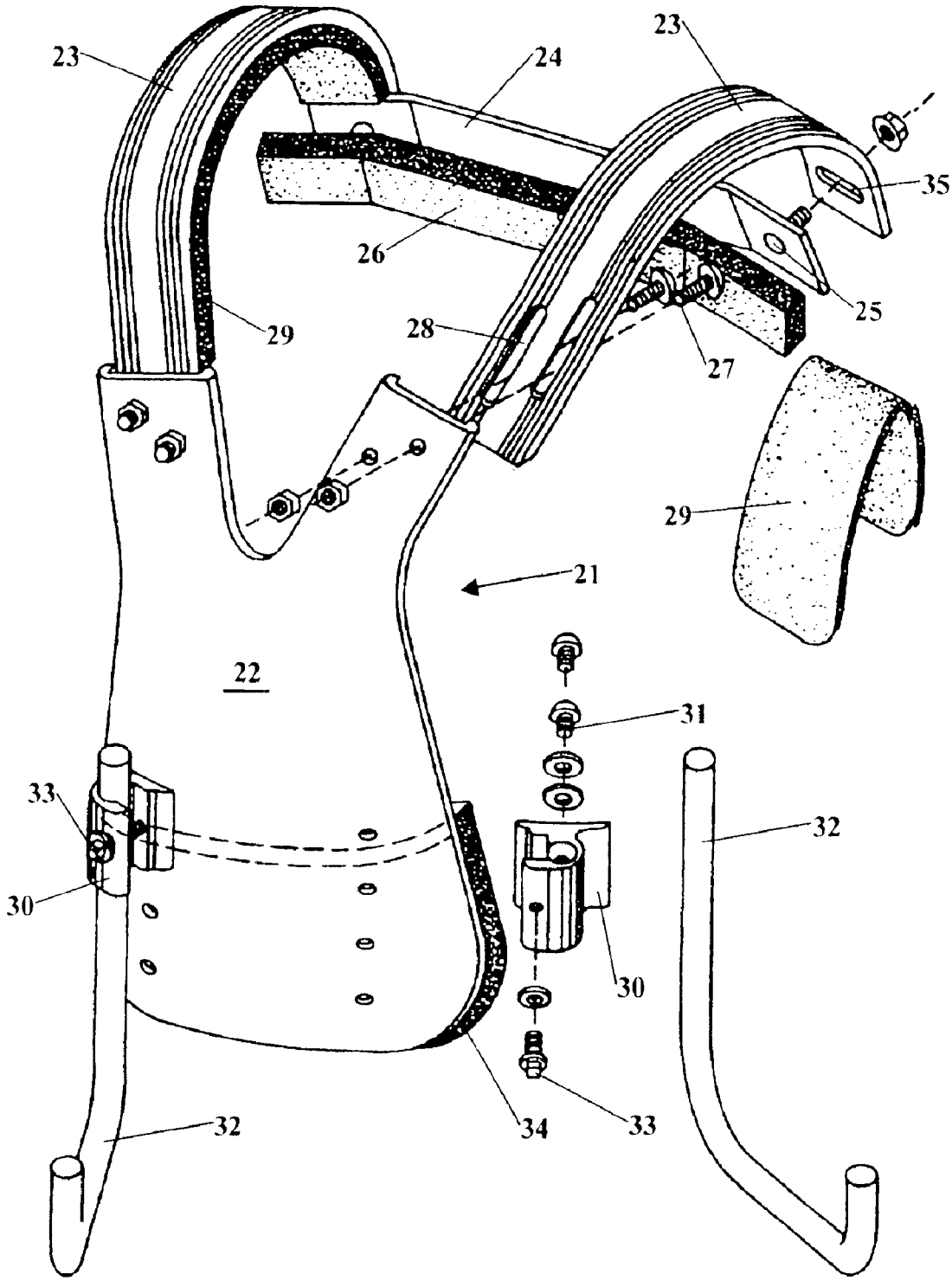
FIG. 2 is an exploded, isometric view of a novel-supporting vest for marching drum assemblies, as in FIG. 1, which is constructed to permit removal and replacement or adjustment of the shoulder straps, adjustable back member and the J-rods.

Another Embodiment of Adjustable Marching Vest Support with Removable Back Member for Drums and Other Percussion Instruments with removable back Member Referring to FIG. 2, there is shown a vest or harness-type carrier 21 for percussion instruments, which comprises a vest portion 22, shoulder straps 23 and back support 24. Back support or back member 24 as shown in this figure is removably secured to shoulder straps 23 by screws bolts or threaded fasteners 25 and has padding 26. Bolts 25 extend out from the removable back member, and extend into elongated slots 35 located in the shoulder straps 23 to allow for width adjustment on one or both shoulder straps. Alternately slots may be incorporated into the back member, and a square neck carriage bolt may be used in prevent rotation of the bolt when tightening the nut. The back member may be secured to removable shoulder straps. Removable shoulder straps of various sizes can be used to accommodate different size users.

Vest portion 22 is adjustably and removably secured to shoulder straps 23 by screws or bolts 27 which extend through elongated slots 28 which permits adjustment of the straps 23 relative to vest portion 22. Shoulder straps 23 have pads 29 to cushion the load of the instruments carried by carrier 21.

Vest portion 22 has a pair of J-rod receptacles 30 secured by screws or bolts 31. J-rods 32 are supported in receptacles 30 and secured in position by square head bolts 33, which may be operated by a drum key (not shown). Receptacles 30 are cast or extruded and have an open edge portion which can flex to clamp J-rods 32 adjustably. Receptacles 30 have an inner surface that is polygonal, in this case, hexagonal, in cross section, which provides a plurality (in this case five) of surfaces that clamp the surface of the J-rods 32. This is a superior clamping arrangement to set screws that provide only one or two point clamping contract. Holes in the base of each receptacle 30 are used for mounting by means of bolts or screws or the like. Aligned holes receive clamping screws 31 which operate on adjustment to clamp or to release the J-rods 32.

The materials of construction used in this carrier 21 are very important for achieving the desired result. The vest portion 22 is preferably a strong, lightweight metal or a composite material such as Fiberglas.RTM. Back member 24 and shoulder straps 23 are rigid and made of a light metal such as aluminum, magnesium or titanium. The straps may also be molded or fabricated from a rigid non-metal material such as plastic. The back member can be removably secured to the shoulder straps. Some prior art vests of this type have been of a one-piece Fiberglas.RTM construction. There were incidents of failure of the shoulder straps from repeated flexing. The metal shoulder straps do not fail in flexure and have the advantage that different sizes are readily accommodated. The vest portion 22 can be of a single size and separate shoulder straps 23 of differing radii for small, medium, large or extra large size may be used or the straps 23 may be adjustable. The cushions 29 may be of any type that adds comfort to the user including but not limited to foam, rubber, felt and other compressible or cushioning medium.

Operation

The operation of this carrier should be apparent but will be described briefly for clarity. The carrier 21 is worn by the musician with the shoulder straps 23 positioned over the shoulders and the vest 22 supported against his abdomen. Pads 29 and 26 on shoulder straps 23 and back support member 24 cushion the load of the instruments carried by carrier 21. The straps 23 are adjustable by means of slots 28 and screws 27 and the J-rods 32 are adjustable in position by means of receptacles 30 and adjustment screws 31, 33. Various shoulder straps 23 will require adjustment to the width of the back bar or back member. The back member width is adjusted by loosening the hardware retaining the back support member and sliding the hardware within slot 35 and then re-tightening the hardware.

In another embodiment, the back member is secured to the shoulder straps. The shoulder straps are changeable or adjustable to allow for user of different sizes. The back member can be secured to the shoulder straps using a variety of permanent joining methods including welding, spot welding, bonding or similar joining methods that lock the members in a fixed orientation. The members may be joined with a variety of other fasteners such as rivets, pop-rivets, selfclinching, swaged, or one-way fasteners that are intended to connect the members, and are not intended for easy removal. A gap may exist between the joined rear member and the adjustable shoulder strap so the rear member and the shoulder strap can rotate or pivot independent from each other. A frictional member such as a bearing, felt, washer, wave washer or other spacer material may be used between the joined rear member and the shoulder strap to provide some resistance to rotation or pivoting.

Vest 22 may have suitable padding 34 over its inner surface, as needed, at the belly plate or at suitable locations to avoid discomfort from the bolts or screws used to assemble the straps to the vest or bolts or screws used to assemble receptacles 30 on the vest. J-rods 32 are inserted in position and secured in place by tightening setscrews 33. The short outer ends of the J-rods are inserted into the J-rod receptacles on the percussion instrument being carried, e.g., drums (single or array), cymbals, xylophone, marimba, or the like.

Figure 3:
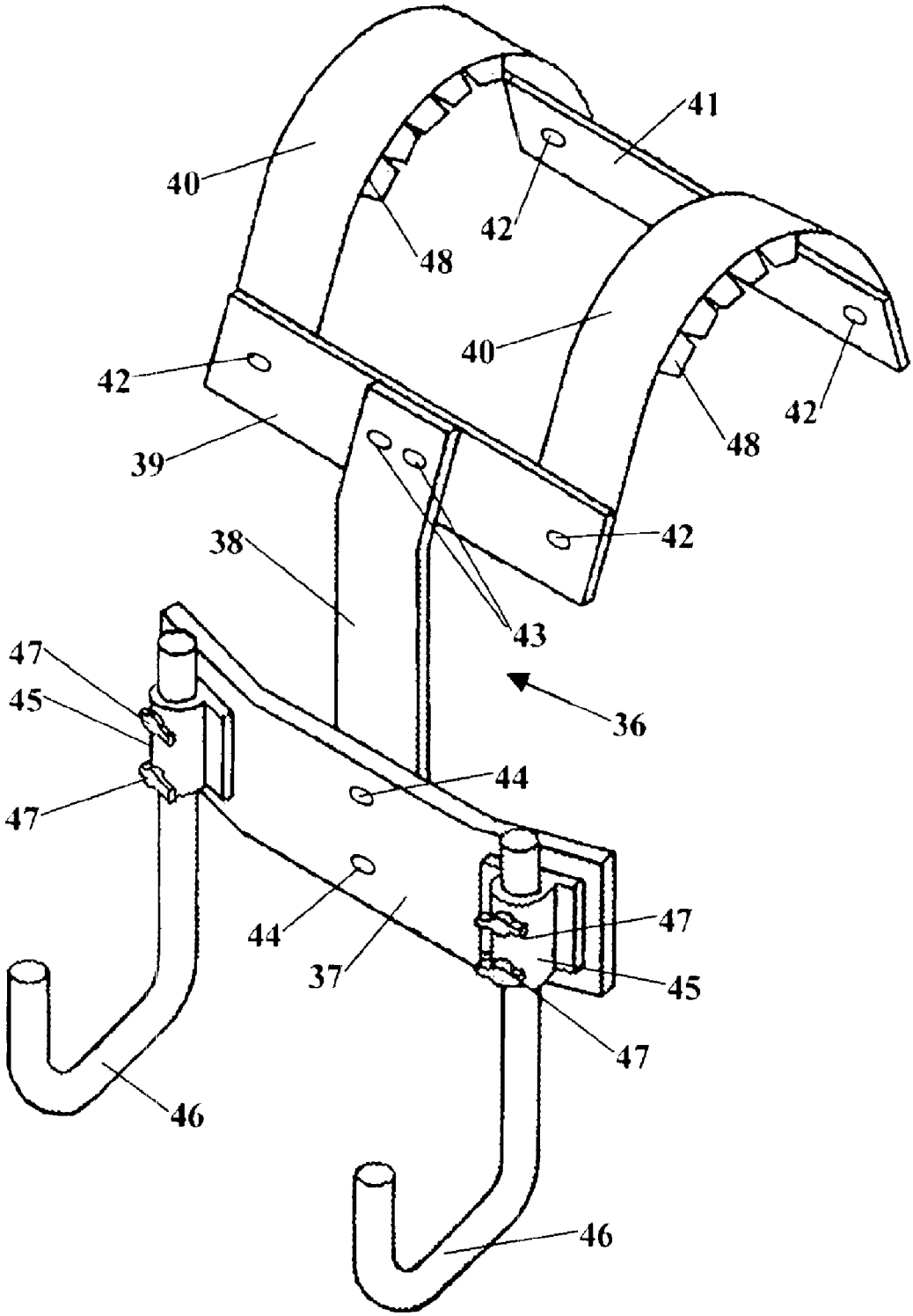
FIG. 3 is an isometric view of a novel T-bar assembly for supporting drums containing features of the supporting vest of FIG. 1 which is constructed to permit removal and replacement or adjustment of the shoulder straps, adjustable back member and the J-rods.

Another Embodiment Marching T-bar Support with Removable Back Member for Drums and Other Percussion Instruments Referring to FIG. 3, there is shown a T-bar-type carrier 36 for percussion instruments which comprises a belly plate 37, vertical bar 38, upper horizontal bar 39, shoulder straps 40 and back member 41. Back member 41 is removably secured to shoulder straps 40 by screws or bolts 42. Where desired, back member 41 may be fixed as by welding or the like. In other embodiments the back member may be removable secured with fasteners. Upper horizontal bar 39 is removably secured to shoulder straps 40 by screws or bolts 42. Upper horizontal bar 39 is removably secured to the upper end of vertical bar 38 by screws or bolts 43.

Belly plate 37 is removably secured to the lower end of vertical bar 38 by screws or bolts 44. A pair of J-rod receptacles 45 is secured on belly plate 37 by screws, bolts, or the like. J-rods 46 are supported in receptacles 45 and secured in position by T-bolts 47. Shoulder straps 40 have pads 48 to cushion the load of the instruments carried by T-bar carrier 36. Pads 48 may also be used in padding back member 41 or vest belly plate portion 37.

The materials of construction used in this carrier 36 are very important for achieving the desired result. The belly plate 37, vertical bar 38, upper horizontal bar 39, shoulder straps 40 and back member 41 are rigid and made of a light metal such as aluminum, magnesium or titanium. The belly plate, vertical bar, horizontal bar, back member and shoulder straps may also be molded or fabricated from a rigid non-metal material such as plastic. The back member can be removably secured to the shoulder straps. The metal shoulder straps have the advantage that different sizes are readily accommodated. The sub-assembly of the belly plate 37, vertical bar 38, upper horizontal bar 39 can be of a single size and separate shoulder straps 40 of differing radii used for small, medium, large or extra large size. The cushions 48 are of a type used to pad the interior of football and other sports helmets. Shoulder straps 40 may be made adjustable as needed.

Operation

The operation of this carrier should be apparent but will be described briefly for clarity. The carrier 36 is worn by the musician with the shoulder straps 40 positioned over the shoulders and the belly plate 37 supported against his abdomen. Pads 48 on shoulder straps 40 cushion the load of the instruments carried by carrier 36. Vertical bar 38 and back member 41 may have suitable padding over inner surfaces, as needed, to avoid discomfort from the bolts or screws used to assemble the straps to the upper horizontal bar or bolts or screws used to assemble the belly plate to the vertical bar. J-rods 46 are inserted in position and secured in place by tightening T-bolts 47. The short outer ends of the J-rods are inserted into the J-rod receptacles on the percussion instrument being carried, e.g., drums (single or array), cymbals, xylophone, marimba, or the like.

Preferred Embodiment Marching Adjustable Removable and Pivoting Back Member for Drums and Other Percussion Instruments.

Figure 4:
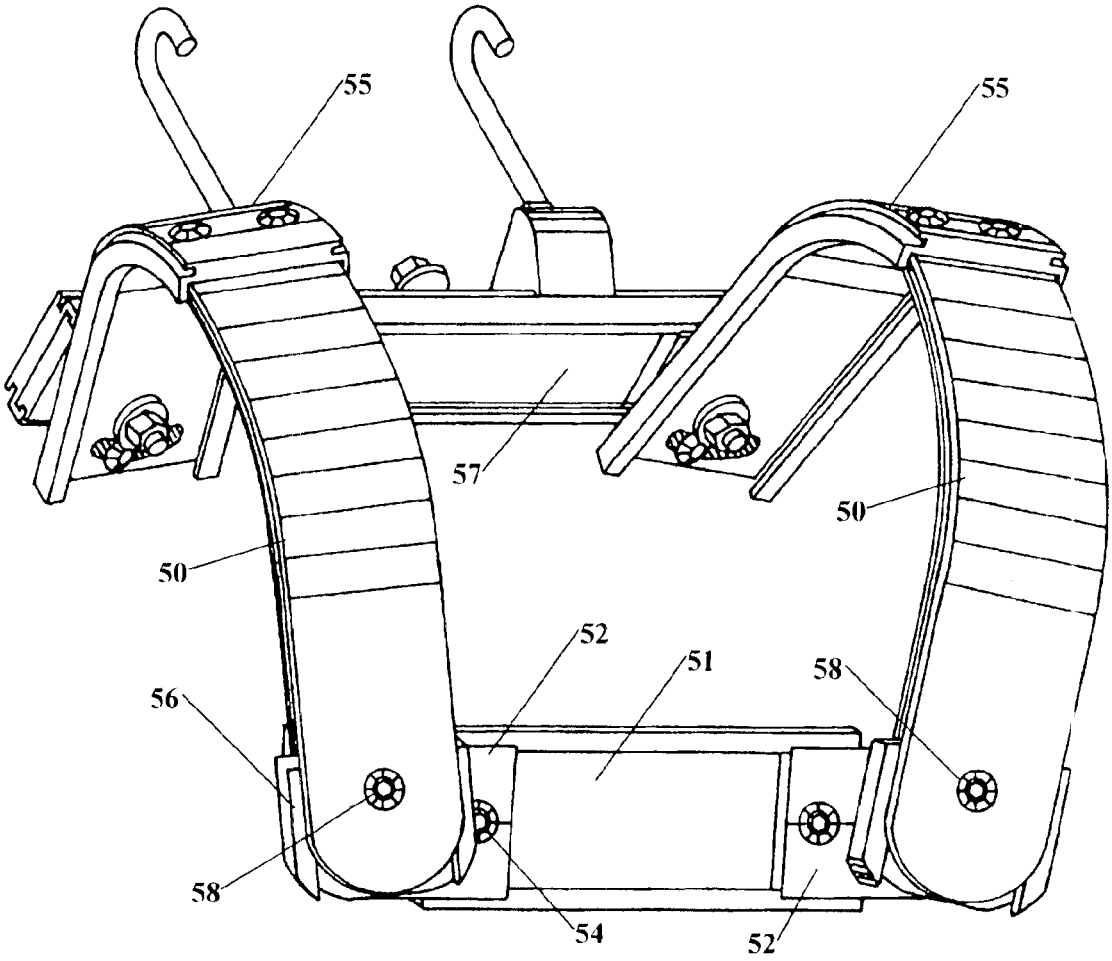
FIG. 4 is an isometric view of a telescoping adjustable back support member that pivots on the shoulder connection straps.

Referring to FIG. 4 there is shown a telescoping adjustable back support member that pivots on the shoulder connection straps. Shoulder straps 50 are shown with front adjustable shoulder straps 55. The front adjustment allows a height adjustment of a horizontal member 57. The shoulder straps connect with a pivoting bushing 58 to the back member pivot connection 56. The pivot connection allows free, frictional, locked rotation or pivoting of the shoulder straps with the back member component 52. The back member pivot connection 56 is attached to the back member telescoping slide 52. The back member telescoping guide slides within a track located in the back member telescoping guide 51. The telescoping components are locked into position with hardware 54. This embodiment shows the back members as components that telescoping, but any method such as hinged or elongated slots are contemplated that allow expansion between the two shoulder straps. Padding can be located on the back member components to add comfort to the user. The components allow multiple adjustments for users of different sizes. In addition, the components can be changed with shoulder straps of differing radii used for small, medium, large or extra large size users. The cushions may be of a type used to pad the interior of football and other sports helmets.

Operation

The operation of this carrier should be apparent but will he described briefly for clarity. The carrier is worn by the musician with the shoulder straps 50 positioned over the shoulders and the rests on the front of the user and is supported against their abdomen by the horizontal member 57. Pads on shoulder straps 50 cushion the load of the instruments. The shoulder straps wrap over the shoulders of the user and terminate at back of the user at a back support member intended to stabilize the load of the instruments on the user. In the preferred embodiment the shoulder straps terminate at a pivoting linkage 56, connected to the back members 51 and 52. The pivoting linkage includes a bushing, bearing and or other hardware that allows the pivoting linkage to rotate or pivot. The hardware may include friction or wavy washers that allow the force or torque required to pivot the shoulder strap and the back member be adjustable. The hardware may be tightened such that the shoulder strap and back member are rigidly linked. The back member may also be removed from the shoulder straps entirely.

In this preferred embodiment, the back member is adjustable for width. The adjustment is accomplished by loosening the hardware 54, and sliding one or both of the telescoping slide 52 within the telescoping guide 51. The telescoping guide consists of a "C" shaped cross-section member, where the flat shaped telescoping guide slide(s) 52 within the telescoping guide 51. Once the desired width of the back member is achieved, the hardware 54 is tightened to lock the width in place.

Detailed Embodiment of Adjustable and Removal Back Member

Figure 5:
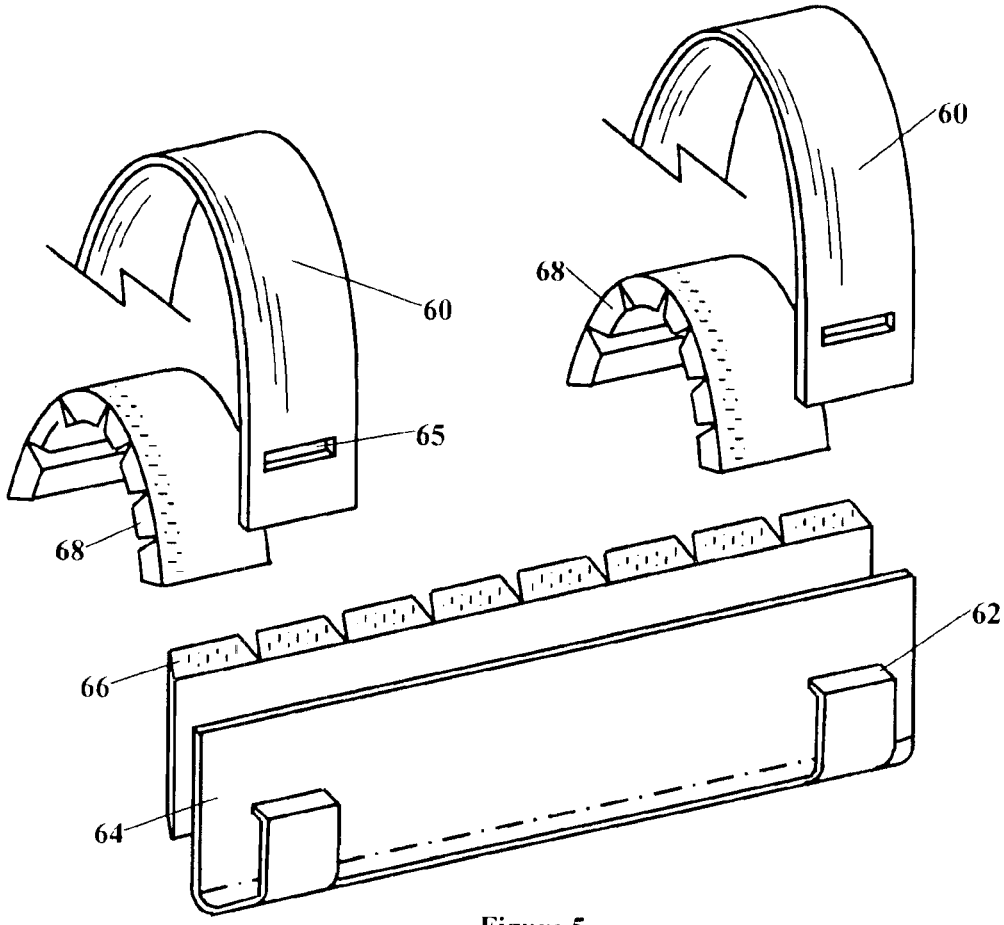
FIG. 5 is an isometric view of a removable back support member where the back member can be removed and installed without tools.

Referring to FIG. 5 there is shown a back member that is removable from the shoulder straps without requiring the use of tools. In this figure only the shoulder straps 60, shoulder padding 68, removable back member 64 and back member padding 66 are shown. The shoulder straps include an elongated slot 65. The elongated slot is shown as a through hole in the shoulder strap. but the slot may be a depression in the back of the shoulder strap(s). The back removable back member includes locking tab 62 that engage into slots 65 in the shoulder straps. The back member can be removed from the shoulder straps by pulling back on the locking tabs and sliding the back member off the shoulder straps. The locking tabs can be narrower than the elongated slots to allow for lateral movement or adjustment in the width of the slots in the shoulder straps. The slots may be larger than the tabs to additionally allow for pivoting of the tabs within the slots. This arrangement of slots and tabs is intended as an example of a removable back member that can be removed without the use of tools. Other methods of removable back member are contemplated such as interference fit, snaps, twist locks, cam locks, Velcro® or similar devices that allow installation and removal of a back member without requiring the use of tools or equipment. The width of the back member may be adjustable using a telescoping arrangement of two or more back member components. The configuration of the remainder of the instrument carrier and back member can be formed from a variety of configurations shown as examples in FIGS. 1, 2, 3, 4 or other styles that can accommodate a removable and or adjustable back member.

Figure 6:
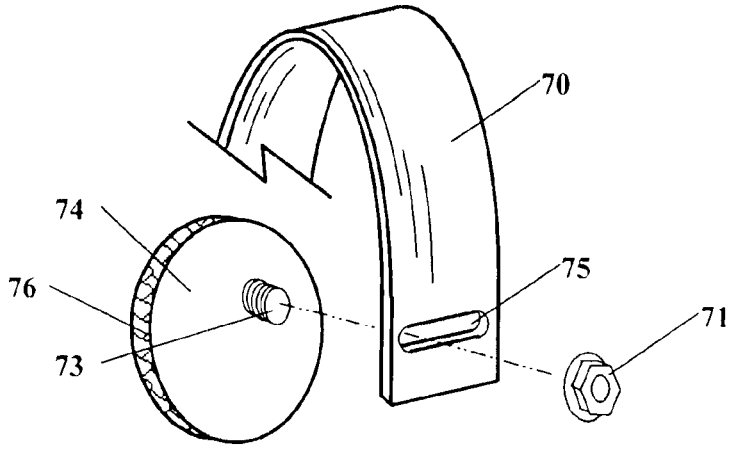
FIG. 6 is a isometric view of one adjustable and removable back support pad.

Referring to FIG. 6 there is shown a isometric view of one adjustable and removable back support pad. In this figure, just one shoulder strap 70 is shown with the back pad. The shoulder strap can be padded with any material that make wearing the instrument carrier more comfortable. The shoulder strap has been defined in other embodiments of this application. The shoulder strap includes an elongated hole 75 located near the end of the shoulder strap, but the shoulder strap may include multiple holes or elongated holes at various positions on the shoulder straps to allow for mounting the shoulder pad at various locations on the shoulder straps.

The back pad 74 includes a cushion 76 located on one side of the back pad. This figure shows the shape of the back pad as round, but the shape of the pad can be any two or three-dimensional shape that provides support to the user. The cushion can be padded with any material that make wearing the instrument carrier more comfortable. The back of the pad includes a fastener 73 that connects through the elongated hole in the shoulder strap. The location of the fastener on the back pad can be in the center of the pad, or can be eccentric with the center of the pad. An eccentric location of the fastener allows locating the pad in a variety of positions to improve the comfort to the user. The pad may additionally include angular adjustment or rotation to further improve comfort to the user. The fastener is secured to the shoulder strap with a nut 71 or other fastening mechanism.

Thus, specific embodiments and applications for a removable and or adjustable back member for a percussion instrument carrier have been disclosed. It should be apparent. however, to those skilled in the art that many more modifications besides those described are possible without departing from the inventive concepts herein. The inventive subject matter, therefore, is not to be restricted except in the spirit of the appended claims.

What is claimed is:

1. A removable back member for a shoulder supported harness assembly for supporting percussion instruments, comprising:

a shoulder supported carrier structure for supporting percussion instruments having at least two shoulder supporting members for securing said structure on the on the shoulders of a user; and a removable back member that can be secured, spanning across and connected to each ofthe said two shoulder supporting members.

2. The shoulder supported harness assembly for supporting percussion instruments according to claim 1, wherein said shoulder support members are rigid shoulder straps and are removably and rigidly secured together.

3. The shoulder supported harness assembly for supporting percussion instruments according to claim 1, wherein said shoulder supporting members are formed of a rigid non-metal material with is fiberglass, a cast molded or formed rigid plastic.

4. A shoulder supported harness assembly for supporting percussion instruments according to claim 1, wherein said shoulder supporting members and said cover member are formed of a rigid light metal, which is magnesium, aluminum or titanium.

5. The removable back member according to claim 1, wherein said removable back member is formed of a rigid non-metal material, which is fiberglass, cast, molded or formed rigid plastic.

6. The removable back member according to claim 1, wherein said removable back member is formed of a rigid light metal, which is magnesium, aluminum or titanium.

7. The removable back member according to claim 1, wherein said removable back member is covered on at least one side with a padding material.

8. The removable back member according to claim 1, wherein said removable back member is adjustable for width.

9. The removable back member according to claim 1, wherein said removable back member attaches to the shoulder support members using an interference fit, snaps, twist locks, cam locks or other fastening method that does not require tools to install or remove said back member.

10. A removable back member for a shoulder supported harness assembly for supporting percussion instruments, comprising:

a shoulder supported carrier structure for supporting percussion instruments having at least two shoulder supporting members for securing said structure on the shoulders of a user, and at least one removable back member that is connected to at least one free end of a shoulder supporting member.

11. The removable back member from claim 10 wherein the width of the back member is adjustable.

12. The pivot mechanism from claim 10 wherein the pivot mechanism is adjustable from removal of the back member to a rigidly linked back member.

13. The removable back member from claim 10 wherein the removable back member comprises one or more separate back members.

14. The shoulder supporting members from claim 10 wherein the shoulder supporting members are adjustable.

15. The shoulder supporting members and or the back member from claim 10, wherein said shoulder supporting members and or the back member is covered on at least one side with a padding material.

16. The removable back member from claim 10 wherein the back member can pivot at the connection with the shoulder support members.

17. A shoulder supported harness assembly for supporting percussion instruments, comprising:

a shoulder supported carrier structure for supporting percussion instruments having changeable or adjustable shoulder supporting members for securing said structure on the shoulders of a user; and a back member that spans across and is secured to each of the shoulder supporting members.

18. The shoulder supports from claim 17 wherein the shoulder supporting members and be adjusted or changed to position the secured back member.

19. The securing mechanism from claim 17 wherein the securing mechanism locks the orientation of the shoulder supporting members and the back member.

20. The securing mechanism from claim 17 wherein the securing mechanism allows the shoulder supporting members to pivot on the back member.

* * * * *